US005680938A

United States Patent [19]

Rubinstein

[11] Patent Number: 5,680,938

[45] Date of Patent: Oct. 28, 1997

[54] APPARATUS FOR HANGING BINDERS

[76] Inventor: Joseph Rubinstein, 20-3 America's Way, Salem, Mass. 01970

[21] Appl. No.: 551,893

[22] Filed: Oct. 23, 1995

[51] Int. Cl.[6] ..... A47B 65/00

[52] U.S. Cl. ..... 211/42; 211/46; 312/184

[58] Field of Search ..... 211/42, 46, 162, 211/71; 312/183, 184, 233; 248/441.1; 281/45–51, 38; D19/32, 33; 402/79, 80 R

[56] References Cited

U.S. PATENT DOCUMENTS

| | | | |
|---|---|---|---|
| D. 278,159 | 3/1985 | Bellanca | 281/38 X |
| D. 329,457 | 9/1992 | Westover et al. | D19/33 X |
| 321,164 | 6/1885 | West | 312/233 X |
| 1,073,854 | 9/1913 | Helmer | 211/46 |
| 1,353,774 | 9/1920 | Mason | 281/38 |
| 2,501,608 | 1/1950 | Lyons | 312/233 |
| 3,043,737 | 7/1962 | Engelstein | 402/79 X |
| 3,248,814 | 5/1966 | Zwolinski et al. | 402/79 X |
| 3,251,363 | 5/1966 | Lundgren | 211/162 |
| 3,298,374 | 1/1967 | Grundell | 281/45 |
| 3,659,820 | 5/1972 | Slifstein et al. | 248/447 |
| 3,684,340 | 8/1972 | Kirkroian | 312/183 |
| 3,798,810 | 3/1974 | Brisson et al. | 211/46 X |
| 3,857,492 | 12/1974 | Michaelis et al. | 211/42 |
| 3,899,082 | 8/1975 | Young et al. | 211/46 |
| 3,913,995 | 10/1975 | Malcik et al. | 312/183 |
| 3,923,353 | 12/1975 | Elias et al. | 211/46 X |
| 3,936,201 | 2/1976 | Kenney et al. | 402/4 |
| 4,312,453 | 1/1982 | Barber | 211/46 |
| 4,426,007 | 1/1984 | Beleckis et al. | 281/45 X |
| 4,449,270 | 5/1984 | Brabant | 281/47 X |
| 4,473,158 | 9/1984 | Barber | 211/46 |
| 4,516,871 | 5/1985 | Leitman | 281/46 X |
| 4,907,706 | 3/1990 | Henderson | 211/46 |
| 4,998,630 | 3/1991 | Schwartz | 211/71 |
| 5,031,782 | 7/1991 | Minervini | 211/162 X |
| 5,078,270 | 1/1992 | Campbell | 211/194 X |
| 5,467,949 | 11/1995 | Lemke | 211/71 X |
| 5,476,336 | 12/1995 | Osiecki et al. | 281/38 X |

*Primary Examiner*—Leslie A. Braun
*Assistant Examiner*—Sandra Snapp
*Attorney, Agent, or Firm*—Pearson & Pearson

[57] ABSTRACT

Apparatus for supporting binders includes a binder insert securable in a binder having a planar portion with a first edge proximate a spine of the binder. A second portion of the binder insert extends from the first portion beyond the cover of a binder and has a transverse portion. The transverse portion slides within a tubular member with an elongated slot. When the tubular member is attached to a horizontal support surface, inserting the transverse portion in the tubular member enables the binder to be supported by the insert with the binder spine lying in a vertical plane.

23 Claims, 6 Drawing Sheets

APPARATUS FOR HANGING BINDERS

BACKGROUND OF THE INVENTION

1. Field of the Invention

This invention generally relates to filing systems and more particularly to systems and apparatus for vertically supporting multiple ring binders and the like.

2. Description of Related Art

Filing systems generally comprise apparatus for the convenient storage of papers, documents and pages. Known filing and support systems generally include a frame structure from which depends a book, binder, folder or like device for retaining papers, documents and/or pages. The following United States Letters Patent illustrate such systems for supporting binders and books:

3,936,201 (1976) Kenney et al.

3,913,995 (1975) Malcik et al.

3,899,082 (1975) Young et al.

3,857,492 (1974) Michaelis et al.

3,684,340 (1972) Kirkorian 3,659,820 (1972) Slifstein et al.

U.S. Pat. No. 3,936,201 to Kenney et al. discloses inserts for ring binders that support the binder spine horizontally. Specifically the inserts engage the binder rings, and hook portions of the inserts extend beyond each end of the binder for engaging horizontal, parallel rails of an open frame of a filing system. The spine of the ring binder thus is horizontally oriented with respect to the rails of the filing system.

U.S. Pat. No. 3,913,995 to Malcik et al. discloses an open frame support structure carrying a tubular member with an axially extending channel. The channel receives a transverse portion of a T-shaped member with a vertical portion extending through a slot in the channel of the tubular member. The vertical portion of the T-shaped member includes apertures for receiving bolts or other securement devices that clamp binder covers and contents together. The T-shaped member, when secured with the binder covers and contents, extends along a spine of the binder thereby defined so that the spine extends horizontally relative to the horizontal plane of the frame.

U.S. Pat. No. 3,899,082 to Young et al. discloses a binder storage arrangement that includes removable flexible hangers that engage a binder along its spine. Each flexible hanger includes horizontally extending rails that engage overhanging flanges of a notebook spine to support the spine in a horizontal position with the covers and contends of the binder depending therefrom. The flexible hangers are adapted to be mounted from a lower horizontal surface of a file cabinet.

U.S. Pat. No. 3,857,492 to Michaelis et al. discloses a loose leaf binder suspension and storage system. In this system a frame having parallel support members carries transversely extending rails with flange members that in turn, extend inwardly from the rails. The flanges on the rails receive corresponding flanges that extend from both sides of a notebook spine to support the notebook with its spine disposed in a horizontal position.

U.S. Pat. No. 3,684,340 to Kirkorian discloses a hanger file device with tubular members that a frame structure supports in a horizontal plane. Each tubular member includes an axially extending channel and through slot. The tubular member receives and supports a second member having a smaller tubular member slidable within the channel with a radially extending planar portion thereof extending through the through slot. A post of a post-binder receives the planar portion so that the file hanging device supports a post-binder horizontally along its spine.

U.S. Pat. No. 3,659,820 to Slifstein et al. discloses book holding brackets and a frame structure. A first bracket adjusts to engage a book adjacent its spine and holds the book in conjunction with a second bracket secured at one end of the first bracket. The frame structure supports the bracket for rotation about an axis to enable rotation of the book from a stored position to an in-use position.

The following United States Letters Patents illustrate other representative filing systems and support systems:

4,998,630 (1991) Schwartz 4,907,706 (1990) Henderson 3,298,374 (1967) Grundell 2,501,608 (1950) Lyons U.S. Pat. No. 4,998,630 to Schwartz discloses a storage device for supporting bags in a hanging position beneath a shelf including a support that attaches to the shelf. The support includes a plurality of parallel, elongated, partially closed tubular channels. Each channel can receive a tubular member that carries a bag depending therefrom. The tubular members are supported within the channel of the support with the bags extending through the partially closed portion of the channel.

U.S. Pat. No. 4,907,706 to Henderson discloses a storage rack for suspending large planar sheets such as printing plates. A plurality of spaced, parallel, inverted T-shaped beams extend from a frame so that channels are defined between the inverted T-shaped beams with a slot defined between adjacent transverse portions of the inverted T-shaped beams. Second T-shaped beams support plates on S-shaped hooks or the like that pass through apertures in the horizontal portion of the T-shaped beams and the plates. The second T-shaped beams are in turn supported in the channels with the horizontal portion of the second T-shaped beams passing through the slot.

U.S. Pat. No. 3,298,374 to Grundell discloses a support system for documents, pamphlets and the like. The support system comprises hook members that extend from an elongated plastic tubular member with a T-shaped channel therein. The T-shaped channel receives and carries a T-shaped top portion of a folded member that carries the documents. Hook members extending from opposite ends of the channel are adapted to overlie file rails of a support frame to thereby suspend documents in a hanging position from the rails.

U.S. Pat. No. 2,501,680 to Lyons discloses a book cabinet with pivotally mounted panel elements. Each panel element supports a book binder within a lower compartment of the cabinet. Swinging a panel element on a horizontal axle enables a user to open the book binder secured to the panel on an upper surface of the cabinet formed by planar surfaces of the other panel elements.

Collectively the foregoing references disclose various apparatus for supporting notebooks, binders, folders, books, files and assorted devices. However the references fail to disclose or suggest a horizontal planar support structure for supporting binders, folders, notebooks and the like so the spine of such binders, folders, notebooks and the like extend perpendicularly from a horizontal portion of a support structure. Furthermore, these references fail to disclose support inserts for binders that enable such binders to be supported in a depending condition with the spine of such binders vertically oriented to a horizontal planar support.

SUMMARY

Therefore it is an object of this invention to provide an apparatus for hanging binders from a horizontal support structure.

It is another object to provide a kit for removably hanging a binder beneath a horizontal support surface.

It is still another object to provide a support insert that will enable a binder to be hung from a horizontal support surface with a vertically oriented space.

It is yet another object of this invention to provide a kit for hanging a binder vertically from a horizontal support surface that is simple to install.

It is yet still another object of this invention to provide a binder insert that serves as a divider for matter retained in the binder.

It is another object of this invention to provide apparatus for hanging binders in a vertical fashion that enables relatively easy insertion and removal of such binders from the apparatus.

It is a further object of this invention to provide a filing system for hanging binders vertically with their spines exposed.

Apparatus according to one aspect of this invention is adapted for use with a binder characterized by a binder spine of a given dimension defined between first and second ends of the binder spine, binder covers connected to the binder spine, and sheet supports associated with the binder spine for securing sheets extending laterally from the spine. Each of the binder covers extends laterally away from the binder spine between opposed lateral edges. A binder insert in accordance with this invention includes a main portion for being located within the binder between the covers with a first edge lying generally parallel with and proximate to the binder spine along an edge line. A second planar portion of the binder insert extends from the main portion beyond one of the lateral edges of each of the binder covers. A transverse support forms an edge termination of the second portion and extends essentially perpendicular with respect to the edge line. The apparatus also includes a securement means proximate the first edge for securement in the binder of the binder insert.

The binder insert may also be part of a kit for hanging binders that includes an elongated member with a slotted channel therein for receiving the transverse support within the channel and the secondary planar portion extending through the slot. The tubular member is further adapted for mounting to a horizontal planar surface. Additionally, the tubular member and binder insert may be part of a binder hanging apparatus that also includes a frame support for supporting the tubular member from a horizontal plane defined by the plane support.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
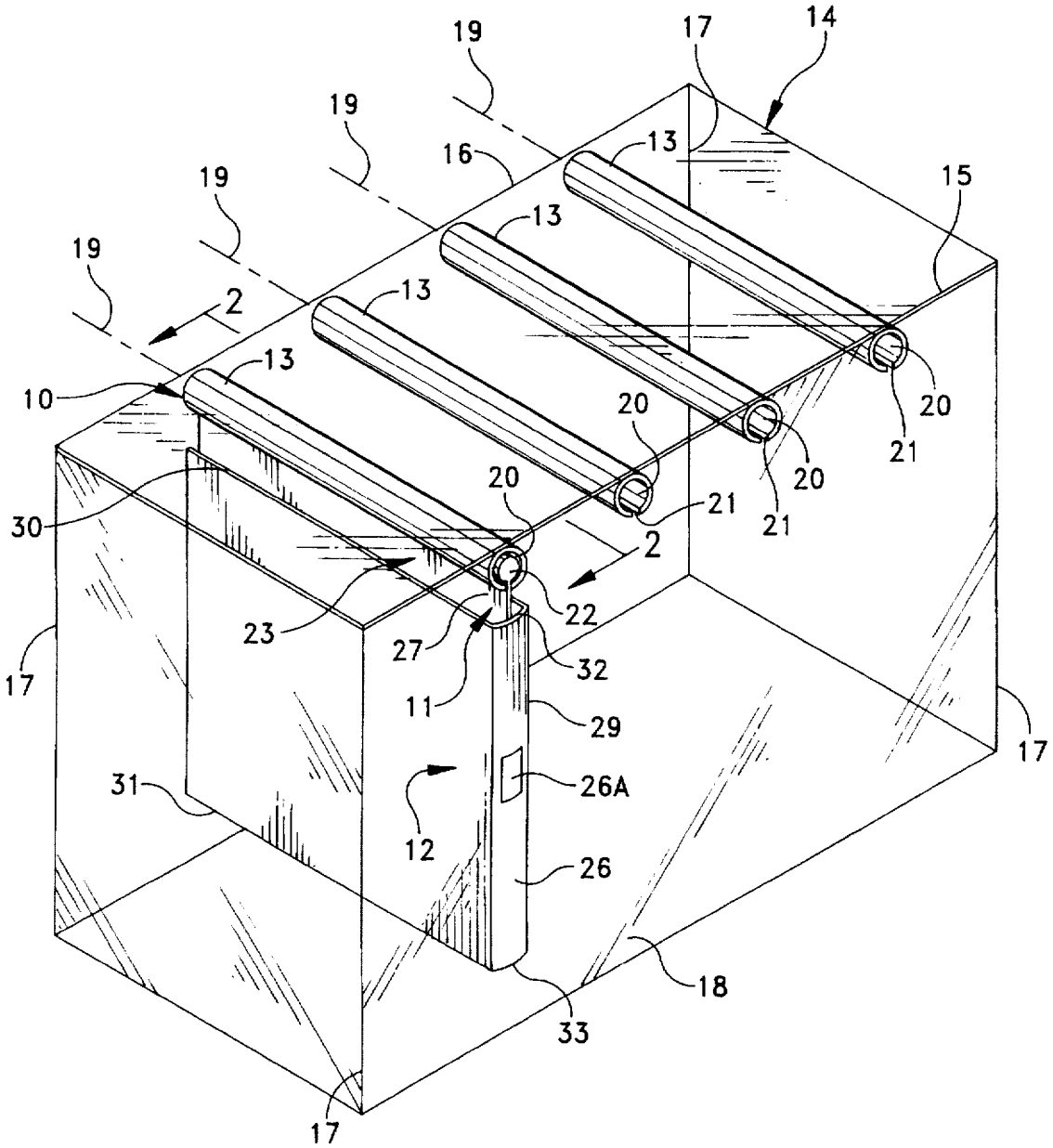
FIG. 1 a perspective view of a binder hanging apparatus according to this invention.
Figure 2:
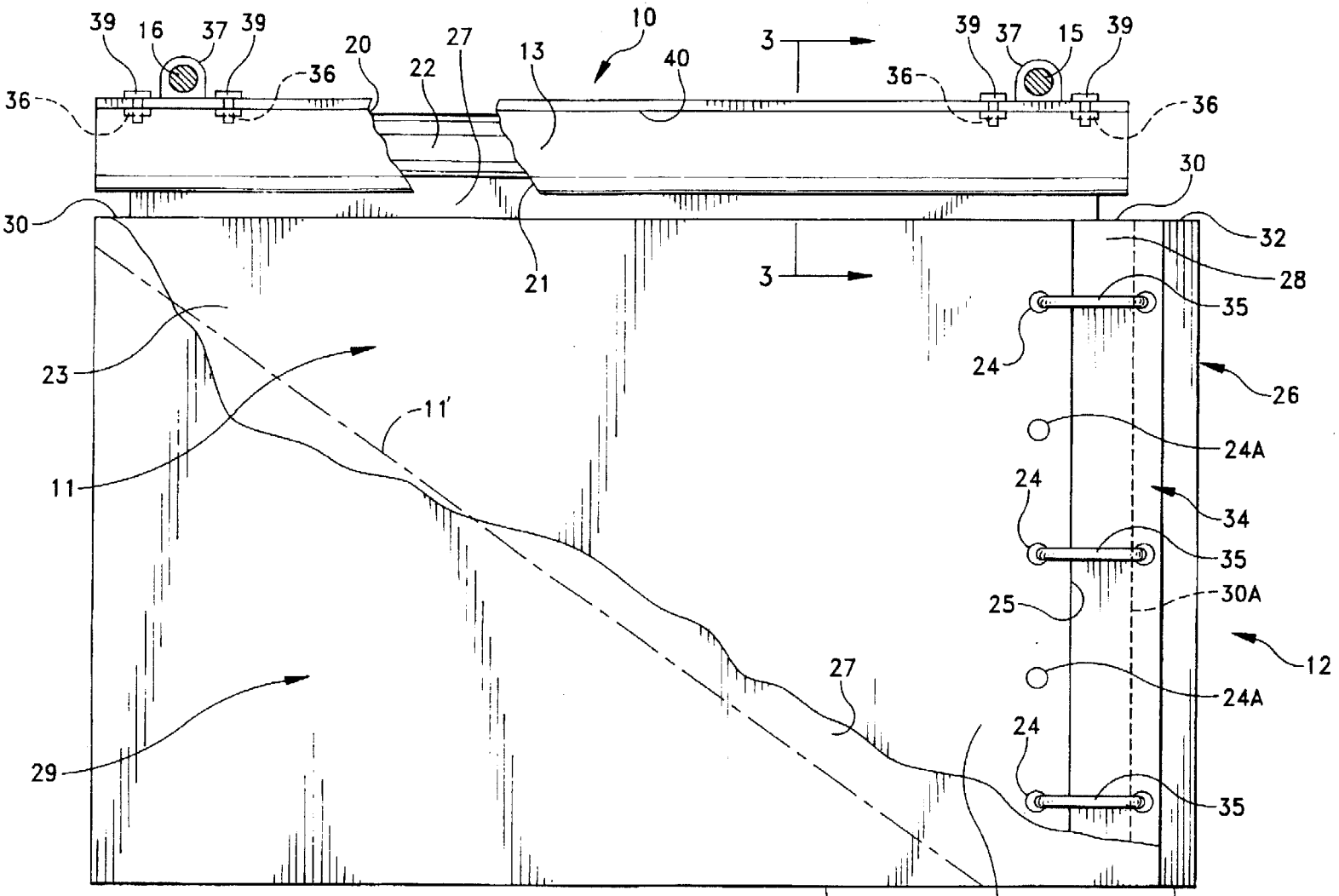
FIG. 2 is a sectional view of the embodiment of FIG. 1 taken along section line 2—2 with portions broken away.

An embodiment of a binder hanging apparatus 10 according to this invention as depicted in FIGS. 1 and 2 comprises a binder insert 11 securable within a binder 12, a tubular support member 13 for receiving the binder insert 11 to support the binder 12 therefrom and an open frame support structure 14 including horizontal members 15 and 16 for carrying the tubular support member 13 and legs 17 for supporting the horizontal members or rails 15 and 16 to define a horizontal plane above a surface 18. In FIG. 1, the horizontal members 15 and 16 support a plurality of the tubular support members 13 arranged along parallel axes 19.

Referring now to FIGS. 1 and 2 each of the tubular support members 13 includes horizontal, elongated, axially extending slotted channel 20 with a slot 21 facing away from the horizontal members 15 and 16. Each of the slotted channels 20 therefore has a size to enable the support member 13 to receive a transversely extending portion 22 of the binder insert 11.

The binder insert 11 also includes a planar sheet 23 that extends vertically from the transverse portion 22. As shown more clearly in FIG. 2, the planar sheet 23 includes the main planar portion 23A having apertures 24 along a first edge 25 for securement in the binder 12 proximate a spine 26 of the binder 12. A second planar portion 27 of the planar sheet 23 connects the transverse portion 22 and the main portion 23A. As particularly shown in FIGS. 2 and 3, when the transverse portion 22 is inserted into one of the tubular members 13, the second planar portion 27 keys with and extends through the keying slot 21.

The support structure 14 of the binder hanging apparatus 10, such as shown in FIG. 1, enables a user to hang the binder 12 with the binder insert 11 secured therein so that the spine 26 of the binder 12 extends transversely to the planes defined by the horizontal members 15 and 16. The transverse portion 22 of the binder insert 11 can easily slide into and out of the slotted channel 20 with the second planar portion 27 extending through the keying slot 21. The transverse portion 22 once inserted is supported by the tubular support member 13 and supports the binder 12. Thus, a user can readily and conveniently use the apparatus to hang and retrieve binders by reference to indicia 26A on the spine 26 of the binder 12.

As more clearly depicted in FIG. 2, the specific embodiment of the binder 12 includes first and second covers 28 and 29 secured to the spine 26 and extending laterally from the spine 26 between opposed, lateral edges 30 and 31 of the covers 28 and 29 (opposed edge 31 of cover 28 not shown in FIG. 2) coplanar with the ends 32 and 33 of the spine 26. In this instance, the binder 12 also includes known sheet support, mechanism 34 secured to the spine 26 that has three rings 35 that selectively and open and lock in a closed position. As depicted in FIG. 2, the apertures 24 in the binder insert 11 align with the rings 35. The rings 35, when closed, securely capture the insert 11 as a structural part of the binder 12. The binder insert 11 is preferably formed of a light-weight sturdy material, such as mylar or polystyrene, so that the binder insert 11 can carry the total weight of the binder and any paper or other sheets (not shown) supported by the rings 35. The binder insert 11, once removably secured in the binder 12, extends away from the spine 26 in a similar fashion as the covers 28 and 29. The main portion 23A of the binder insert 11 has a size corresponding to the size of the covers 28 and 29. As depicted by phantom line 11', the main portion 23A of the binder insert 11 can be formed as a rectangle, triangle or other shape.

Figure 3:
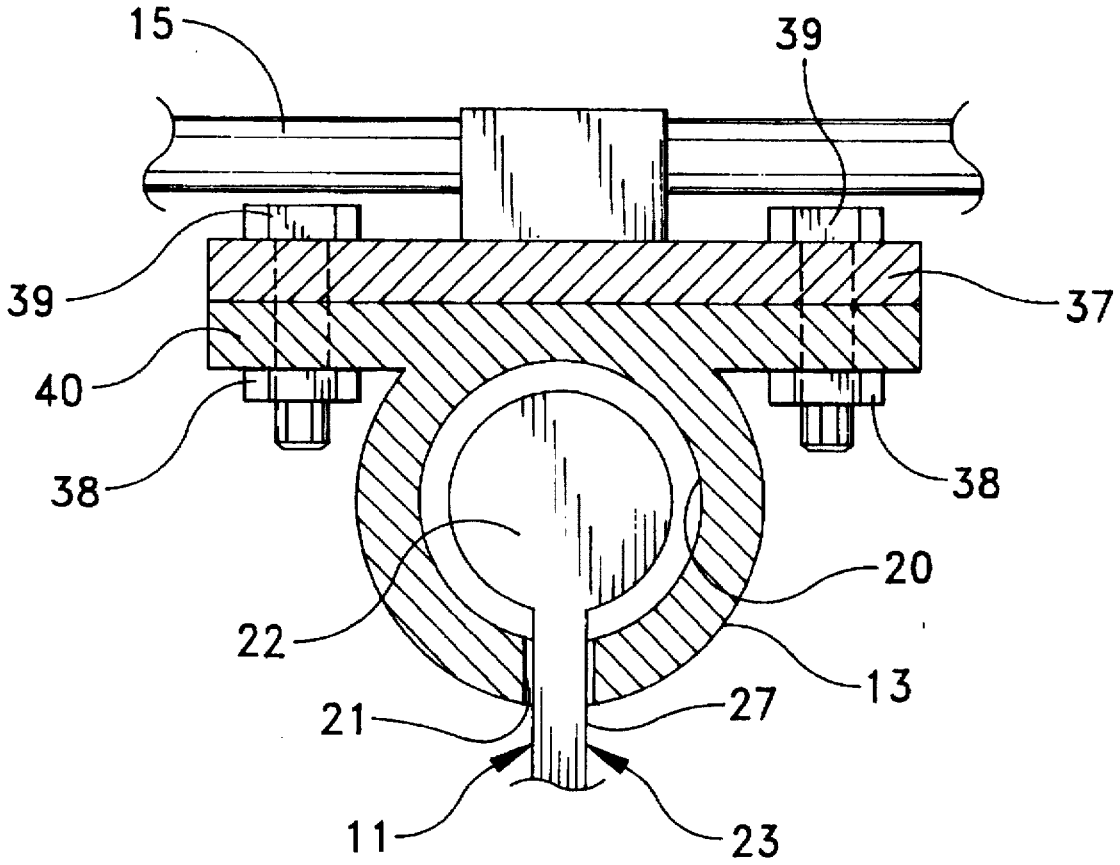
FIG. 3 is a sectional view of the embodiment of FIG. 1 taken along section line 3—3 of FIG. 2.

The means for securing the tubular support members 13 to the horizontal members 15 or 16, as depicted in FIG. 3, includes a bracket 37 that extends over the horizontal member 15. Nuts 38 and bolts 39, or the fastening devices, can affix horizontally extending flanges 40 on the bracket to the member 15.

Figure 4:
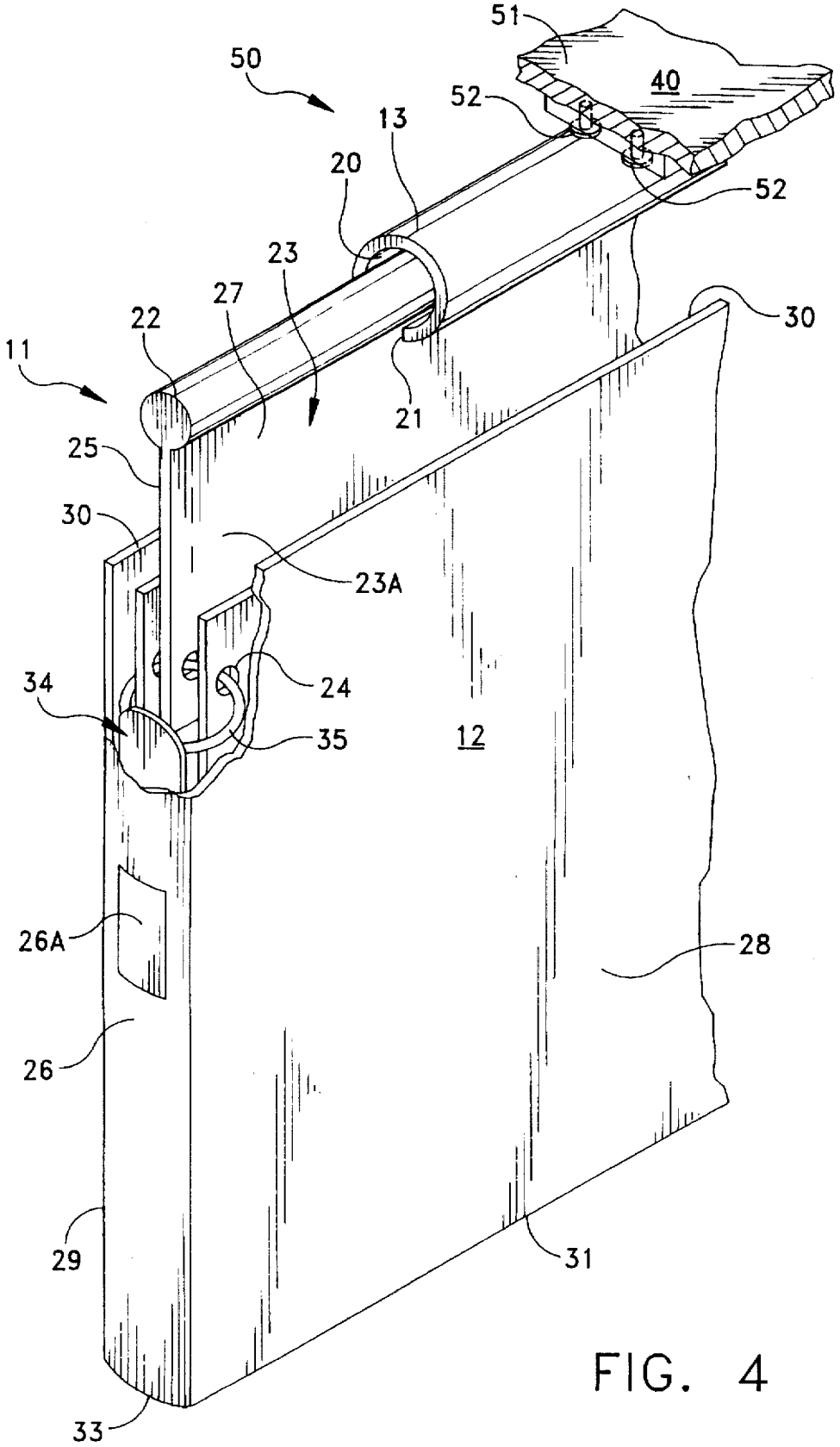
FIG. 4 is a view similar to FIG. 2 of another embodiment of the present invention.

FIG. 4, depicts an alterative embodiment of binder hanging apparatus 50 according to this invention. In this instance the horizontal rails 15 and 16 of the embodiment of FIG. 1 have been replaced with a planar horizontal support member 51 which can comprise a horizontally supported shelf structure or the like, such as a shelf in a bookcase. In any event, the horizontal flanges 40 of the tubular member 13 provide a structure for enabling screws 52 to secure the tubular member 13 to the horizontal member 51. The screws can be replaced by other suitable fastening devices such as nails, nuts and bolts, or the like according to the nature of the material of the horizontal member 51 and its preparation.

The binder insert 11 and the tubular member 13 of the embodiment of FIGS. 1 and 4 comprise a kit for removably hanging binders from a support structure. That is, a user can mount tubular members 13 on a lower horizontal support surface like the surfaced defined by the horizontal members 15 and 16, of the support structure 14 or other suitable mounting surface. The user then secures the binder insert 11 in a binder such as the three ring binder as shown in FIGS. 1 and 2 or other suitable binder such as a two-ring binder, five-ring binder, an ACCO® file folder, or the like having two rings, prongs or similar binders that correspond with apertures 24A.

Furthermore, those skilled in the art will now recognize the binder insert 11 of this invention may be permanently bound within a book binding kit or book such as by a Velobind® binder. In such cases the binder insert 11 would include appropriately shaped apertures instead of or in addition to the apertures 24. While in binders using other binding methods, such as those using adhesive to secure pages to the spine of the binder, the binder insert 11 would not require any apertures. Additionally, it will now be appreciated that the material and strength of the tubular member 13 and the binder insert 11 and the lateral and vertical dimensions of the binder insert 11 can be selected according to the nature of the binder and the mass of the material in which the binder insert 11 is to be secured. Thus, for typical applications the tubular support members 13 and the binder insert 11 will be formed of plastic. For heavy binders, aluminum or other materials may be more advantageous.

Figure 5:
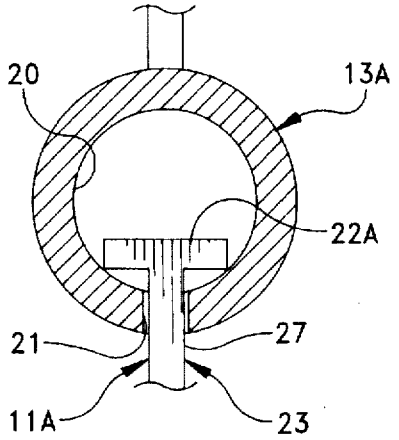
FIGS. 5 through 7 are views similar to the view of FIG. 3 of still other embodiment of the invention.
Figure 6:
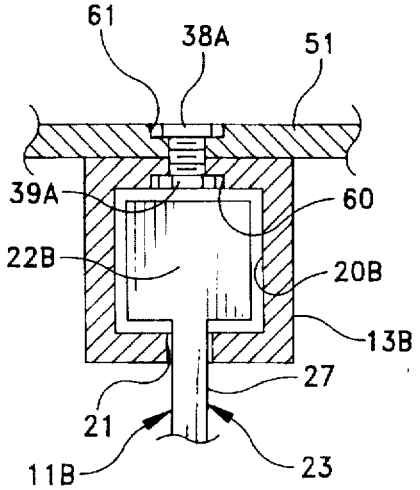
Figure 7:
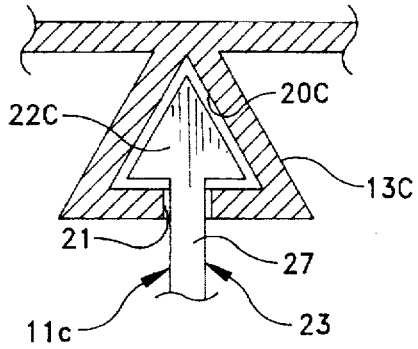

The transverse portions 22 of the binder insert 11 of the embodiments of FIGS. 1 and 4 are depicted as circular members which correspond in size to the channel 20 for the tubular member 13. Those skilled in the art will appreciate that other arrangements can also be employed. FIGS. 5 through 7 represent some such other embodiments. In FIG. 5 the planar portion 27 of the insert 11A depends from a generally planar transverse portion 22A retained in and supported in the channel 20. The embodiment of FIG. 6 includes a rectangular cross-section tubular support member 13B that supports a rectangular cross-section transverse portion 22B of a binder insert 11B. This configuration will of course handle other appropriately sized and shaped transverse members such as. transverse portion 22 of the embodiments of FIGS. 1 and 4, provided that the cross-section of the channel 20B circumscribes the transverse portion 22. The support member 51 of the embodiment of FIG. 6 further includes counter-sunk apertures in the tubular support member 13B to receive the bolts 39A and nuts 38A. FIG. 7 depicts yet another binder insert 11C with a transverse portion 22C having a triangular cross-section corresponding to the triangular cross-section of a slotted channel 20C of a tubular member 13C.

Figure 8:
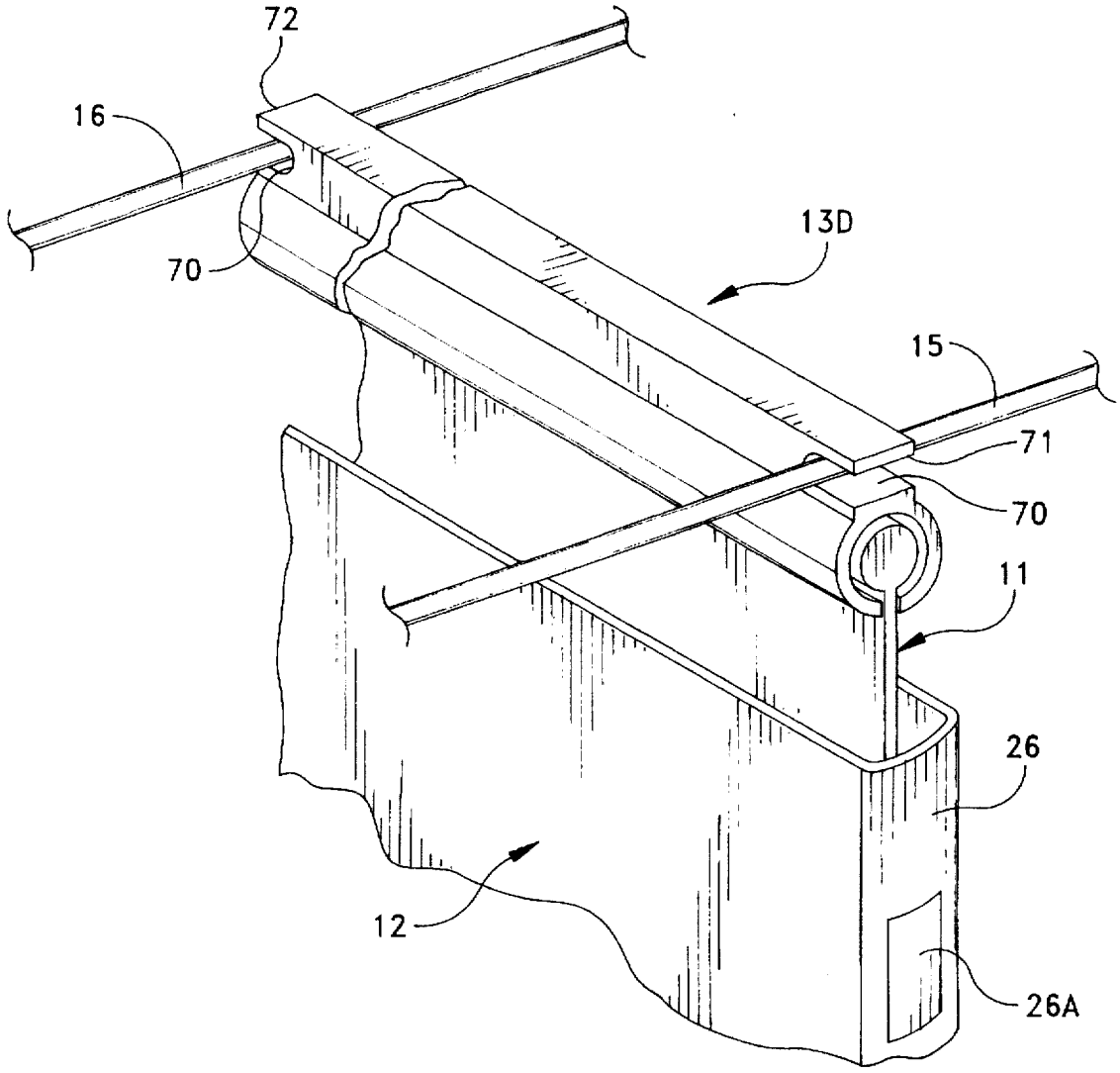
FIG. 8 is a perspective view of yet another embodiment of this invention.

FIG. 8 depicts a further tubular member 13D that includes slots 70 in opposed ends 71 and 72 for receiving rails 15 and 16. In this case, the user would obliquely orient the tubular member 13D in the horizontal plane of the rails 15 and 16. By then turning the tubular member 13D in the horizontal plane to a transverse orientation relative to the rails 15 and 16, the slots 70 engage the rails 15 and 16 and support the tubular member 13D therefrom.

In summary, there have been disclosed several embodiments of apparatus for hanging binders including an insert for a binder with a termination edge outside the binder periphery, typically extending beyond the top edge of the binder. This termination constitutes a means for securing the insert in a horizontal support thereby to hang the binder from the supports in accordance with certain objects of this invention. It will also be apparent that the binder and insert will be easily inserted and removed from such a support. Moreover, it will be apparent that inserts and tubular supports can be provided as individual units for implementing this invention or can be provided with auxiliary bookshelves or the like as complete apparatus. Additionally the binder insert serves as a divider for organization of sheets and other material retained in the binder. The binder insert also enables a user to turn with relative ease sheets retained in the binder. That is, for example, upon opening the binder a user could grasp the binder insert and by turning the binder insert in the binder thereby concurrently turn each sheet overlying the binder insert.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A binder insert for a binder having a binder spine of a given dimension defined between first and second ends of the binder spine, binder covers connected to the binder spine along opposed sides of the binder spine with each binder cover extending laterally from the binder spine between lateral edges of the binder cover, and sheet supports associated with the binder spine for securing sheets extending laterally from the spine intermediate the binder covers, said binder insert comprising:

A. a main planar portion for being located within the binder between the binder covers, a first edge of said portion lying generally parallel with and proximate to a binder spine, B. securement means in said main portion proximate said first edge for securement in the binder by the sheet supports, C. a secondary planar portion of said binder insert extending from and coplanar with said main planar portion to terminate beyond one of corresponding lateral edges of the binder covers, and D. a transverse support formed as an edge termination of said secondary planar portion and extending essentially perpendicularly with respect to said first edge.

2. A support insert as recited in claim 1 wherein the binder includes spaced rings for supporting removable sheets, said securement means comprising a plurality of spaced apertures proximate said first edge of said main portion that are positioned for engaging the rings.

3. A support insert as recited in claim 2 wherein said transverse support has a cylindrical cross-section.

4. A support insert as recited in claim 2 wherein said transverse support and said secondary portion have a T-shape cross-section.

5. A support insert as recited in claim 2 wherein said transverse support has a polyhedron cross-section.

6. A support insert as recited in claim 1 wherein said transverse support has a cylindrical cross-section.

7. A support insert as recited in claim 1 wherein said transverse support and said secondary portion have a T-shape cross-section.

8. A support insert as recited in claim 1 wherein said transverse support has a polyhedron cross-section.

9. A support insert as recited in claim 1 wherein said secondary planar portion includes a portion that extends beyond one of the ends of the binder spine.

10. A binder hanging kit for removably hanging from a support structure a binder with a binder spine of a given dimension defined between first and second ends of the binder spine, binder covers connected along opposed sides of the binder spine to the binder spine and each binder cover extending laterally from the binder spine between lateral edges of the binder cover and sheet supports associated with the binder spine for receiving sheets extending laterally from the binder spine, said binder hanging kit comprising:

A. a binder insert including:

i. a first relatively thin, planar sheet portion having a first edge, ii. securement means on said planar sheet portion proximate said first edge for securement in the binder by the sheet supports, iii. a second planar sheet portion extending from and coplanar with said first planar portion to terminate beyond one of the lateral edges of each of the binder covers wherein said insert is secured in a binder, iv. a transverse support formed as an edge termination of said second planar sheet portion and extending essentially perpendicular with respect to said edge line, and p1 B. an elongated, slotted tubular member securable to a support structure for receiving said transverse support therein whereby said transverse support is slidable within said tubular member and said second planar sheet portion extends through said slot of said tubular member.

11. A binder hanging kit as recited in claim 10 wherein said transverse support has a cross-section corresponding to the cross-section of said tubular member.

12. A binder hanging kit as recited in claim 11 wherein said transverse support and said tubular member have cylindrical cross-sections.

13. A binder hanging kit as recited in claim 11 wherein said transverse support and said tubular member have polyhedron cross-sections.

14. A binder hanging kit as recited in claim 10 wherein said transverse support and said second portion have a T-shaped cross-section.

15. A binder hanging kit as recited in claim 10 for use with a binder having spaced rings at the spine comprising the binder supports, wherein said securement means comprises a plurality of correspondingly spaced apertures proximate said first edge of said main portion for engaging the rings.

16. A binder hanging kit as recited in claim 10 further comprising fasteners for fixing said tubular member to a surface of a support structure.

17. A binder hanging kit as recited in claim 10 further comprising a plurality of apertures in said tubular member opposingly disposed to said slot for receiving portions of fasteners therethrough to enable fixing said tubular member to a selected planar surface of a support surface.

18. A binder hanging kit as recited in claim 10 wherein said second portion includes portions that extend beyond one of the ends of a binder spine.

19. A binder hanging apparatus for removably hanging a binder spine of a given dimension defined between first and second ends of the binder spine, binder covers connected to the binder along opposed sides of the binder spine and each binder cover extending laterally from the binder spine between lateral edges of the binder cover, and sheet supports associated with the binder spine for securing sheets extending laterally from the spine, said binder hanging apparatus comprising:

A. a support structure defining a horizontal plane,

B. an elongated axially extending tubular member with an axially extending channel and slot therein supported by said support structure transversely relative to opposed sides of the defined plane, said tubular member further including means for securing said tubular member to said structure with said slot extending in a plane transverse to said first plane, and C. binder hanging means for supporting the binder from said tubular member, said binder hanging means comprising:

i. a main planar portion having means proximate an edge thereof for securement in a binder along the binder spine by sheet supports, ii. a second planar portion connected to and coplanar with the main planar portion and extending to terminate beyond one edge of a cover, and iii. a transverse portion formed as an edge termination of said second portion and extending essentially perpendicular with respect to the edge of said main planar portion, said transverse portion being sized for insertion into said channel and said second portion sized to pass through said slot whereby, upon disposing said transverse member in said channel with said second portion extending through said slot, said binder hanging means supports a binder with its binder spine transversely oriented relative to the defined plane.

20. A binder hanging apparatus as recited in claim 19 wherein said support structure includes first and second parallel horizontal members defining the plane.

21. A binder hanging apparatus as recited in claim 19 wherein said transverse support extends laterally a distance corresponding to a length of said tubular member.

22. A binder hanging apparatus as recited in claim 19 further comprising a second tubular member similar to said first tubular member, said second tubular member supported by said support structure parallel to said first tubular member.

23. A binder hanging apparatus as recited in claim 19 further comprising a plurality of said tubular members and a plurality of said binder hanging means, each of said plurality of tubular members being supported in a spaced parallel relationship by said support structure and being adapted to receive one of said plurality of binder hanging means whereby said binder hanging apparatus is adapted for hanging a plurality of binders.

* * * * *